US008337241B2

(12) United States Patent
Foung

(10) Patent No.: US 8,337,241 B2
(45) Date of Patent: Dec. 25, 2012

(54) FRONT LOAD KEYSTONE D-SHAPE CONNECTOR

(76) Inventor: Paul Foung, North Brunswick, NJ (US)

( * ) Notice: Subject to any disclaimer, the term of this patent is extended or adjusted under 35 U.S.C. 154(b) by 161 days.

(21) Appl. No.: 13/025,357

(22) Filed: Feb. 11, 2011

(65) Prior Publication Data

US 2012/0196473 A1 Aug. 2, 2012

(30) Foreign Application Priority Data

Jan. 28, 2011 (TW) ..... 2010201955

(51) Int. Cl.
*H01R 13/60* (2006.01)
*H01R 13/66* (2006.01)

(52) U.S. Cl. ..... 439/536; 439/362; 439/544

(58) Field of Classification Search ..... 439/557, 439/544, 362, 552, 554, 555, 545, 536; 49/553
See application file for complete search history.

(56) References Cited

U.S. PATENT DOCUMENTS

| | | | | |
|---|---|---|---|---|
| 4,261,633 | A * | 4/1981 | Abernethy | 439/406 |
| 5,041,018 | A * | 8/1991 | Arnett | 439/536 |
| 5,044,981 | A * | 9/1991 | Suffi et al. | 439/533 |
| 5,302,140 | A * | 4/1994 | Arnett | 439/557 |
| 5,624,274 | A * | 4/1997 | Lin | 439/417 |
| 5,735,714 | A * | 4/1998 | Orlando et al. | 439/676 |
| 6,234,836 | B1 * | 5/2001 | Schmidt et al. | 439/557 |
| 6,814,624 | B2 * | 11/2004 | Clark et al. | 439/676 |
| 7,040,933 | B1 * | 5/2006 | Ma | 439/676 |

* cited by examiner

*Primary Examiner* — Hae Moon Hyeon
(74) *Attorney, Agent, or Firm* — Jackson IPG PLLC

(57) ABSTRACT

A front load keystone D-shape connector includes a D-shape connector body having a plurality of conducting terminals located on one side thereof, and a frame shell holding the D-shape connector body therein and mountable in one mounting slot on a keystone wall plate/keystone panel, the frame shell having hooks backwardly extended from a back side thereof and adapted for insertion into one mounting slot on the keystonewall plate/keystone panel from a front side for hooking on a part of the keystone wall plate/keystone panel inside the mounting slot. Thus, the invention enhances the application range and convenience of use of a D-subminiature/digital video interface connector.

17 Claims, 12 Drawing Sheets

FRONT LOAD KEYSTONE D-SHAPE CONNECTOR

BACKGROUND OF THE INVENTION

1. Field of the Invention

The present invention relates to a front load keystone D-shape connector and more particularly, to a front load keystone D-sub (D-subminiature) or DVI (Digital Video Interface) connector that can be directly inserted into a keystone wall plate or keystone panel from the front side.

2. Description of the Related Art

Most keystone wall plates or keystone panels have a fastening structure located on the back side for securing a keystone adapter. Because a keystone adapter is to be inserted into a keystone wall plate or keystone panel from the back side, the size of the adapter is constrained to the size of the mounting slot of the keystone wall plate or keystone panel.

Further, a D-subminiature connector or digital video interface connector has a large size not mountable in a mounting slot or a keystone wall plate or keystone panel from the back side. This problem limits the application range of conventional D-subminiature connectors and digital video interface connectors.

SUMMARY OF THE INVENTION

The present invention has been accomplished under the circumstances in view. It is one object of the present invention to provide a front load keystone D-shape connector, which can be conveniently installed in a mounting slot of a keystone wall plate or keystone panel from the front side.

To achieve this and other object of the present invention, a front load keystone D-shape connector comprises a D-shape connector body and a frame shell carrying the D-shape connector body. The D-shape connector body comprises a plurality of conducting terminals located on one side thereof. The frame shell holds the D-shape connector body therein and is mountable in one mounting slot on a keystone wall plate/keystone panel, comprising at least one hook backwardly extended from a back side thereof and adapted for insertion into one mounting slot on a keystone wall plate/keystone panel from a front side or hooking on a part of said keystone wall plate/keystone panel inside the mounting slot. Subject to the aforesaid design of the present invention, the invention broadens the application range of D-subminiature male/female connectors and digital visual interface male/female connectors.

DETAILED DESCRIPTION OF THE INVENTION

Figure 1:
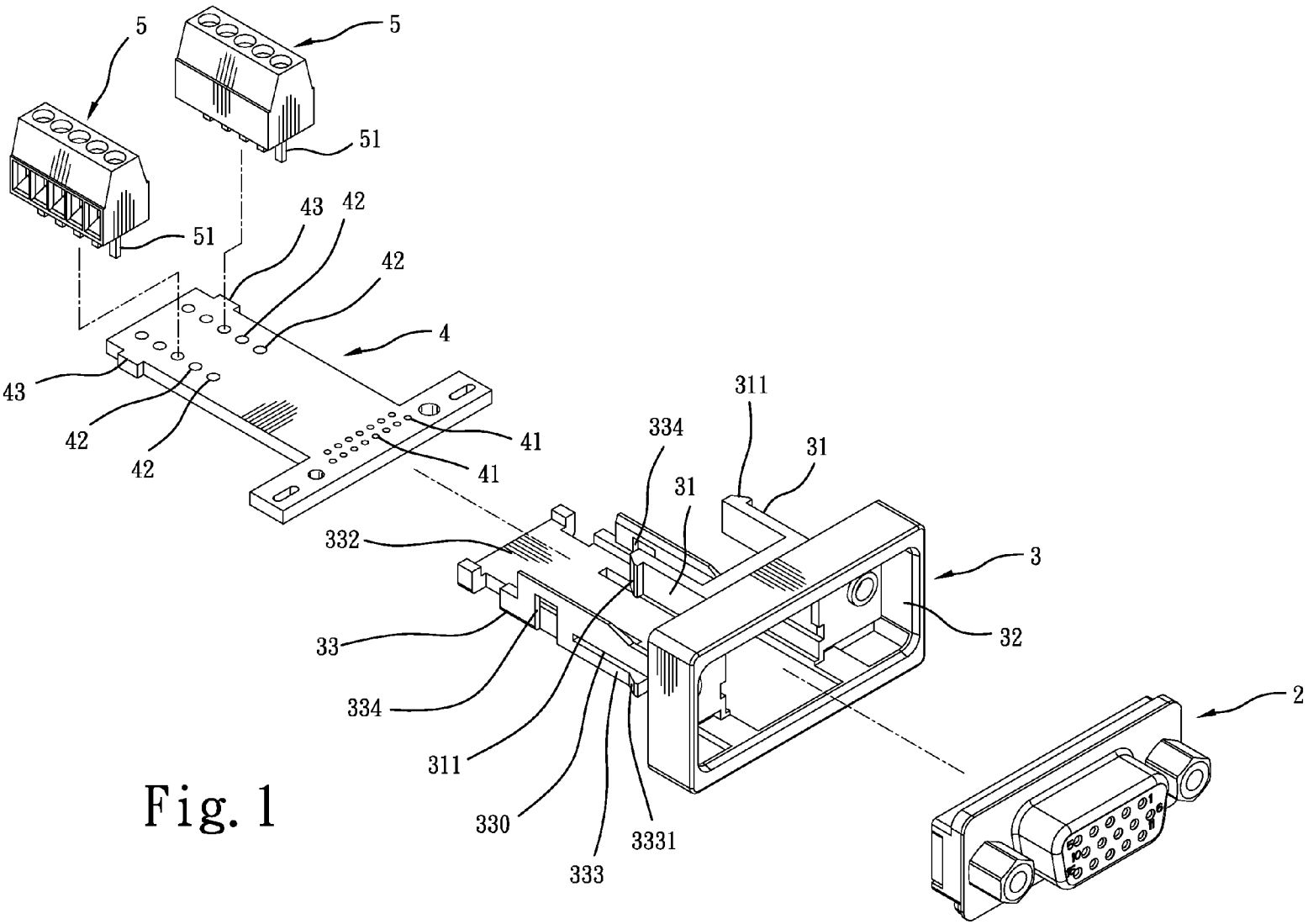
FIG. 1 is an exploded view of a front load keystone D-shape connector in accordance with a first embodiment of the present invention.
Figure 2:
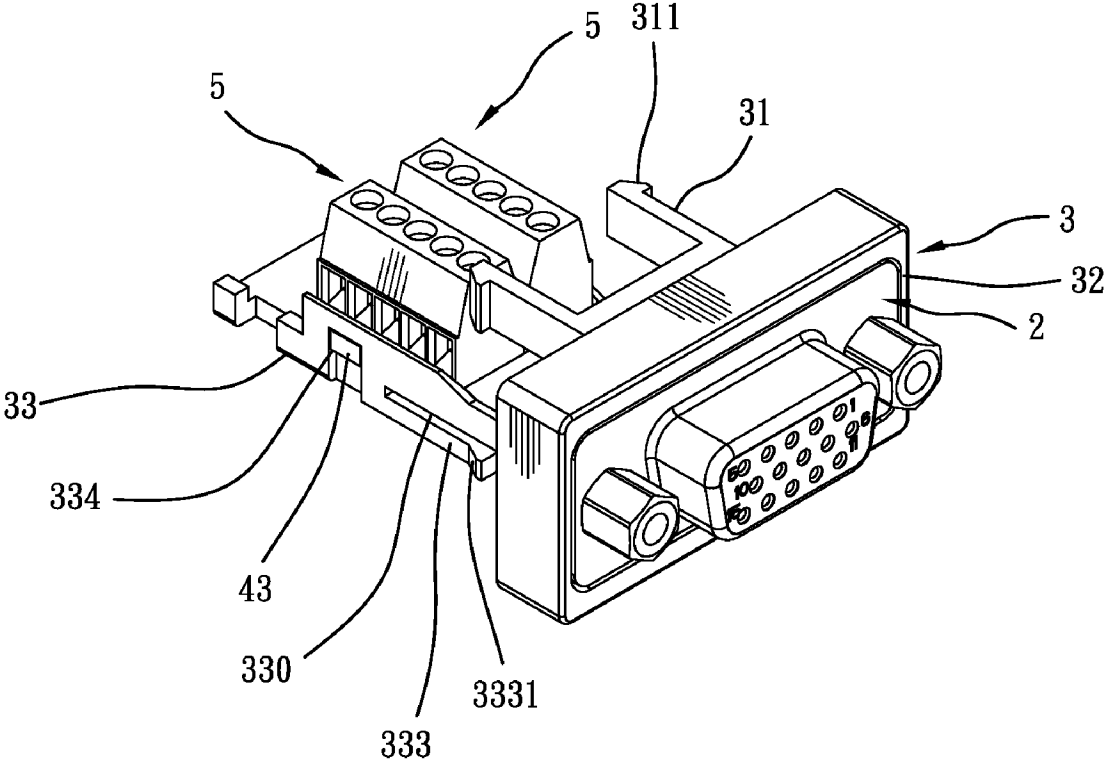
FIG. 2 is an elevational assembly view of the front load keystone D-shape connector in accordance with the first embodiment of the present invention.
Figure 3:
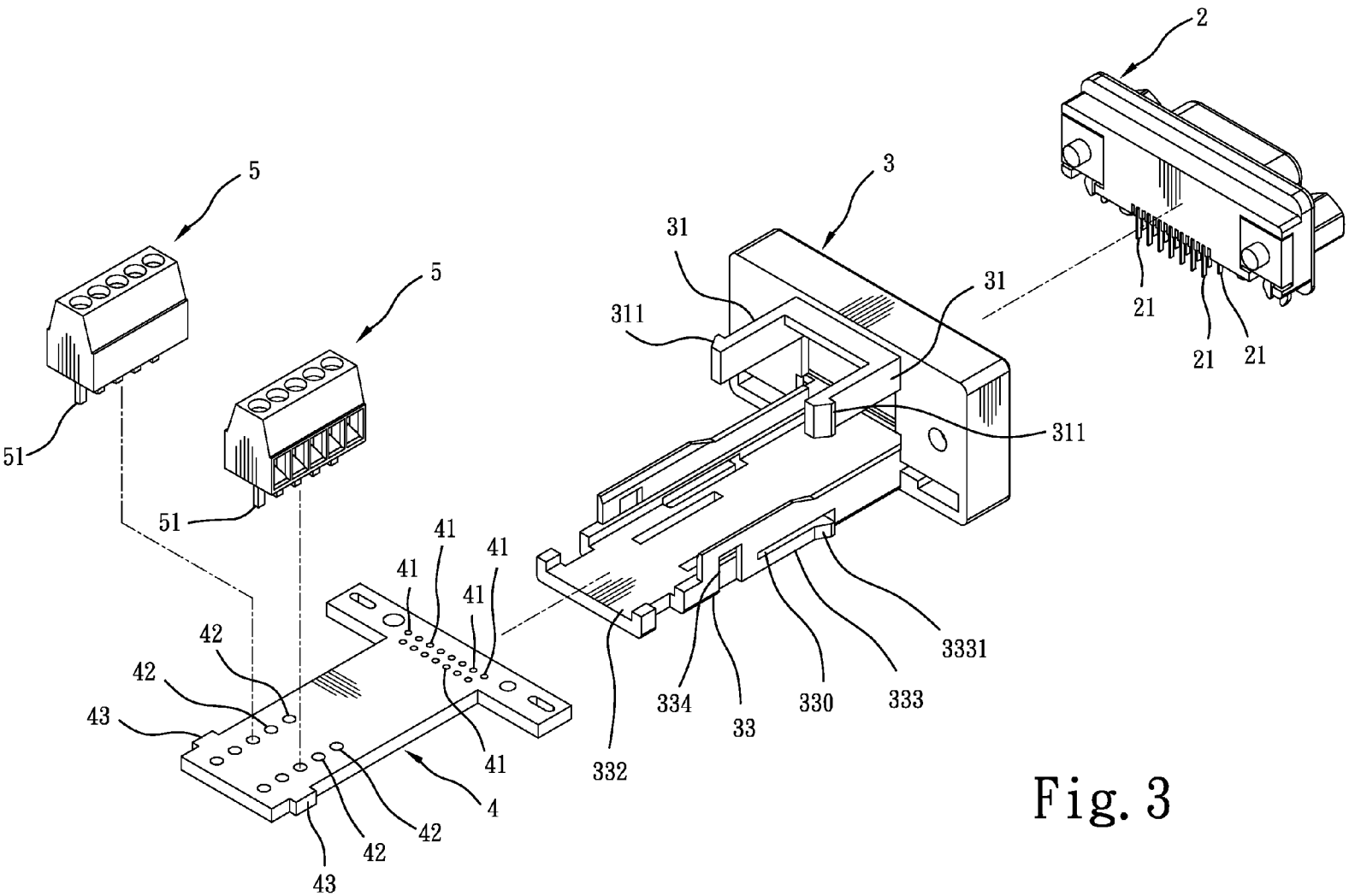
FIG. 3 corresponds to FIG. 1 when viewed from another angle.
Figure 4:
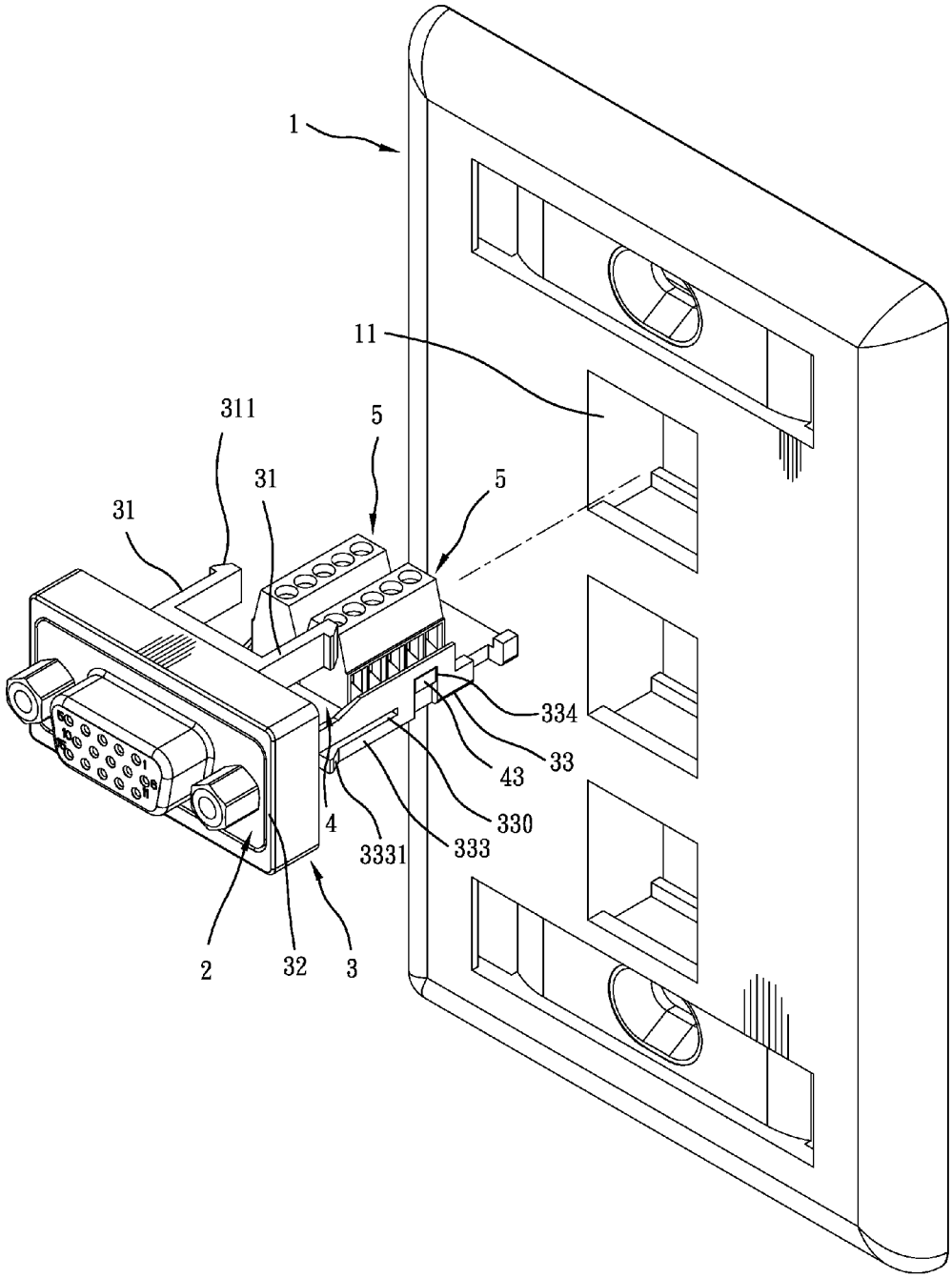
FIG. 4 illustrates the relationship between the front load keystone D-shape connector of the first embodiment of the present invention and a keystone wall plate before installation.
Figure 5:
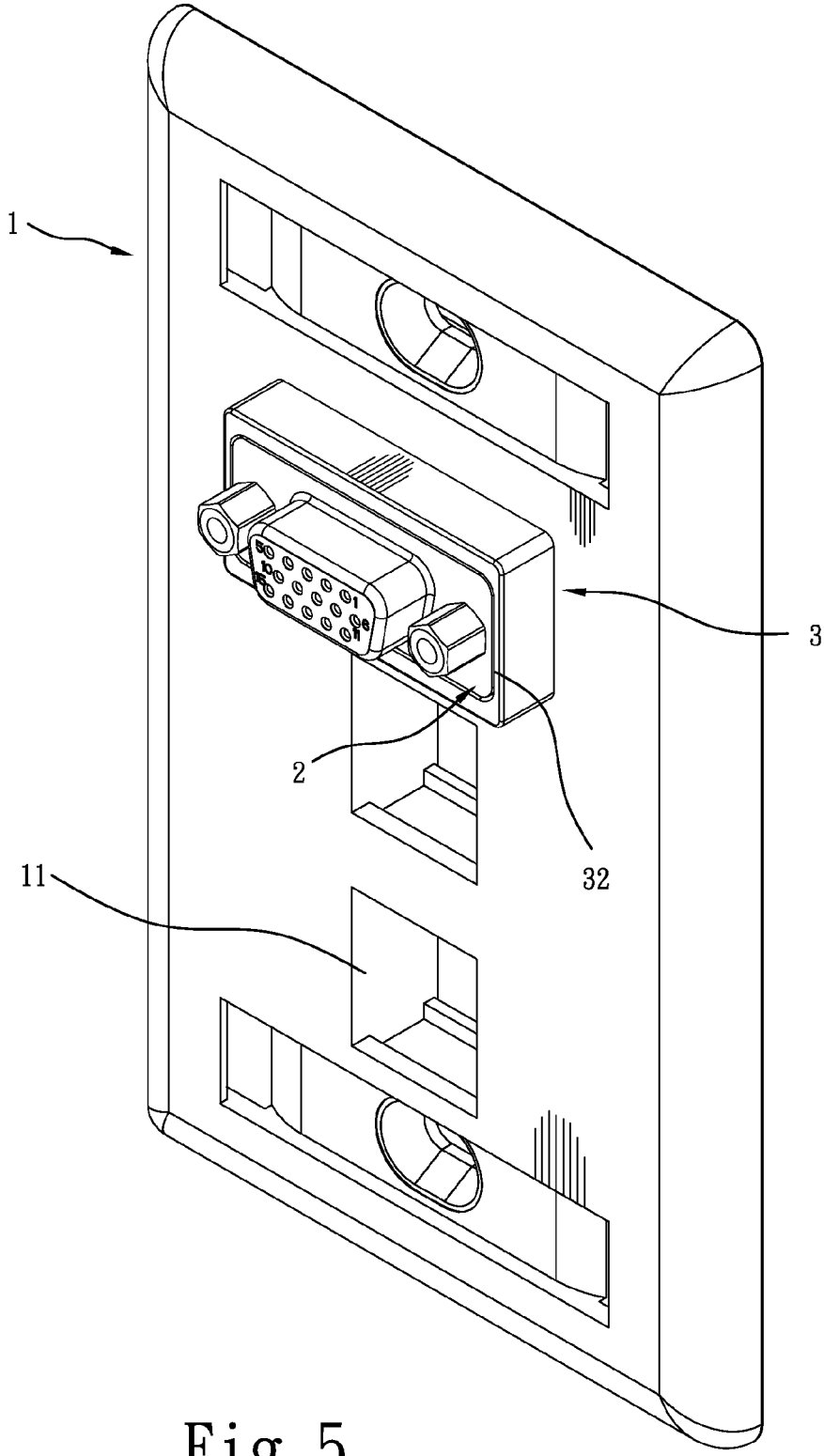
FIG. 5 corresponds to FIG. 4, illustrating the front load keystone D-shape connector installed in one mounting slot of the keystone wall plate.
Figure 6:
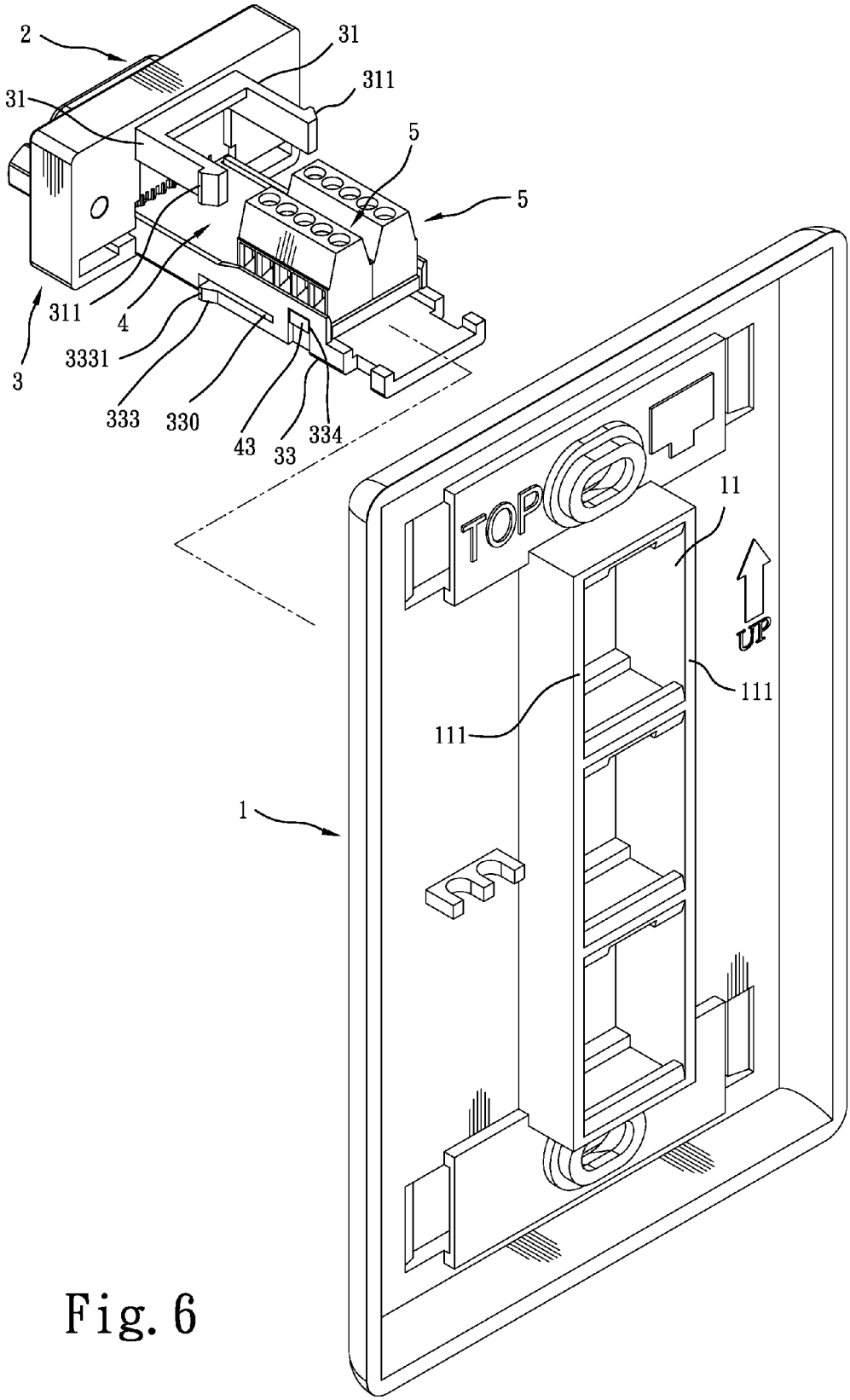
FIG. 6 corresponds to FIG. 4 when viewed from another angle.
Figure 7:
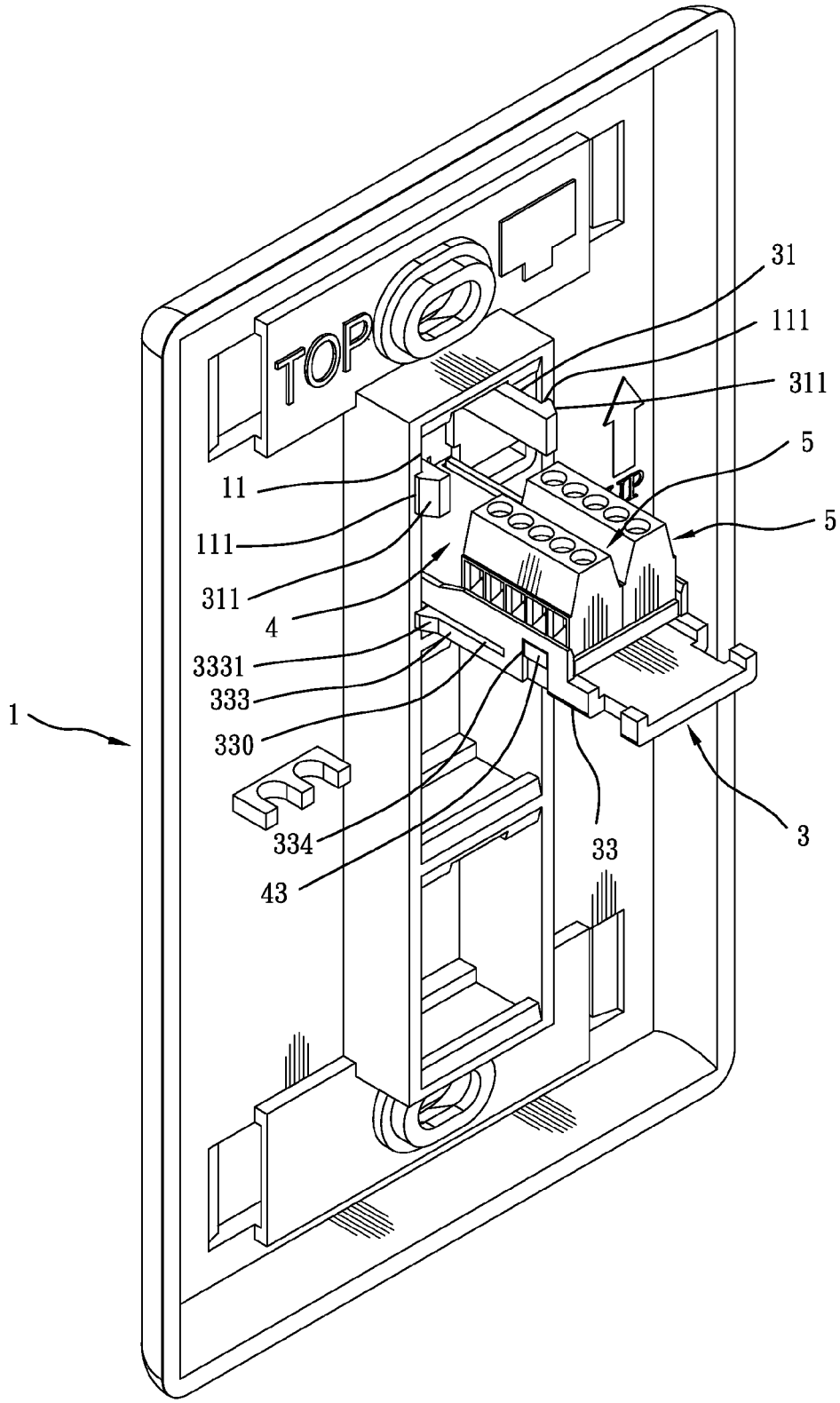
FIG. 7 corresponds to FIG. 5 when viewed from another angle.
Figure 8:
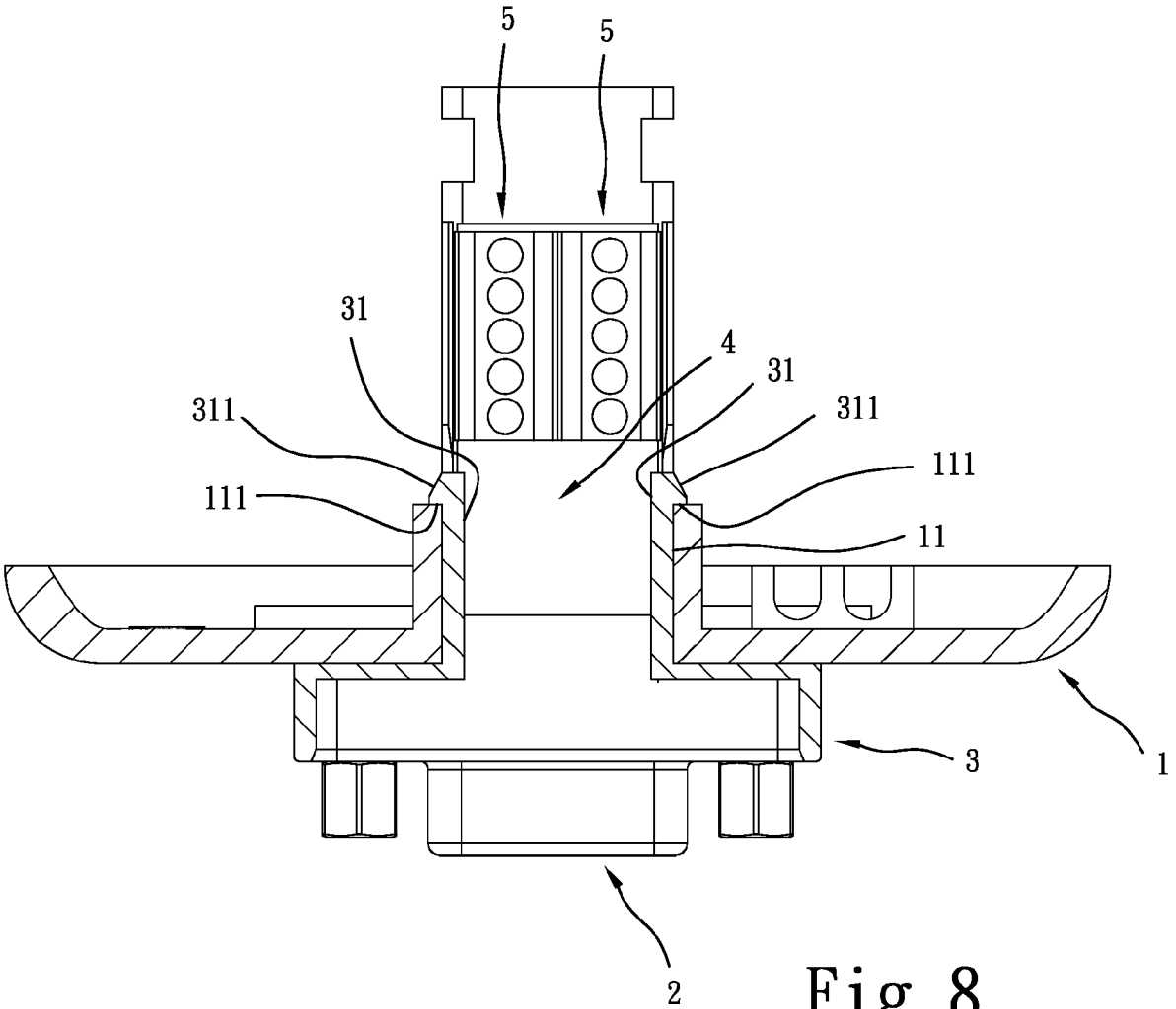
FIG. 8 is a sectional side view in an enlarged scale of a part of FIG. 5.
Figure 9:
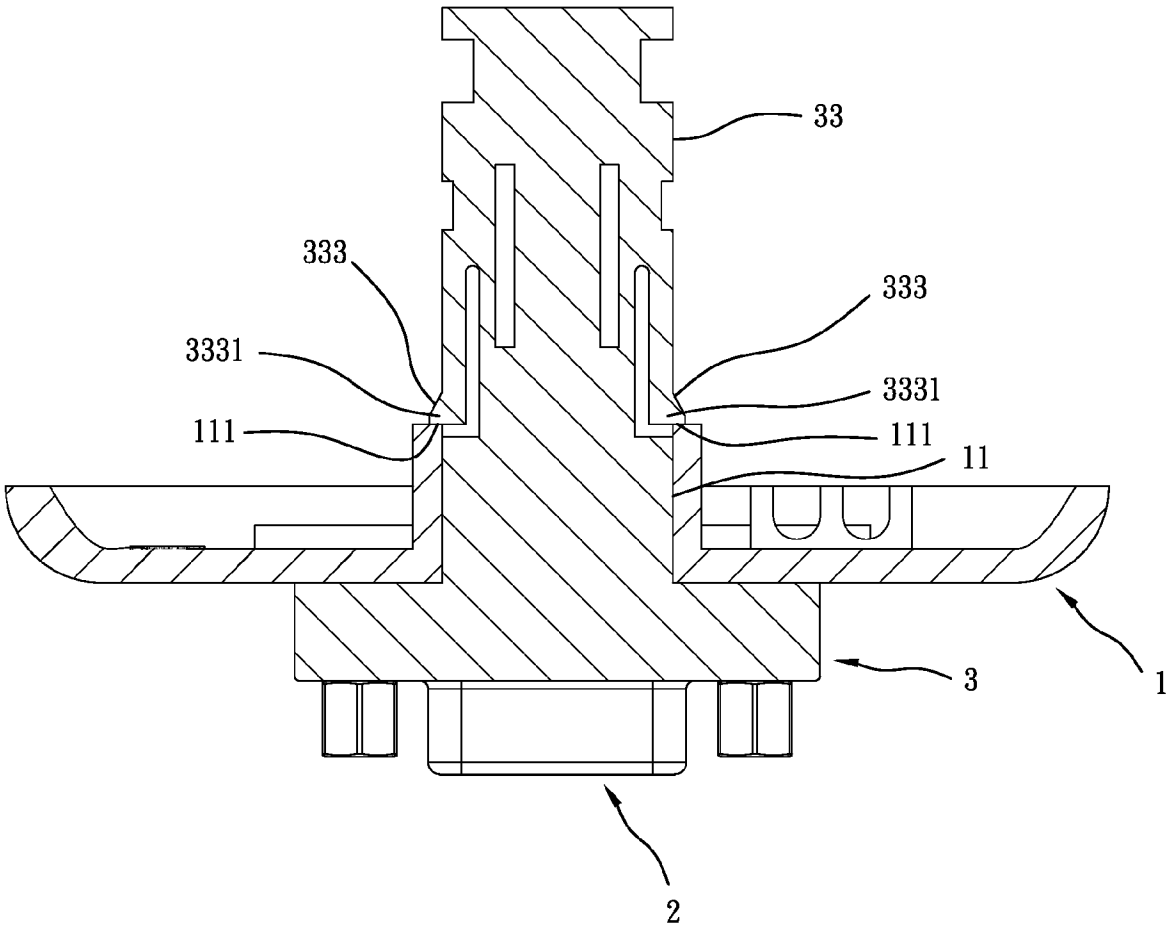
FIG. 9 corresponds to FIG. 8 when viewed from another angle.

Referring to FIGS. 1~9, a front load keystone D-shape connector in accordance with a first embodiment of the present invention can be directly inserted into one mounting slot 11 on the front side of a keystone wall plate 1 or one mounting slot (not shown) on the front side of a keystone panel (not shown), comprising a D-shape connector body 2, a frame shell 3, a circuit board 4 and at least one terminal block 5.

The D-shape connector body 2 is mounted in the frame shell 3, comprising a plurality of conducting terminals 21 located on one side thereof (see FIG. 3) and electrically connected to the circuit board 4.

The frame shell 3 comprises at least one hook 31 respectively backwardly extended from the back side thereof for hooking in one mounting slot 11 on the front side of a keystone wall plate 1 or keystone panel, each hook 31 having a hooked portion 311 located on the distal end thereof for hooking on a locating flange 111 on the back side of the keystone wall plate 1 or keystone panel around the mounting slot 11 (see FIGS. 6 and 7), a first accommodation chamber 32 located on the front side thereof, and a rear extension block 33 backwardly extended from the back side in a parallel manner relative to the at least one hook 31. The rear extension block 33 has a height and a width relatively smaller than the height and width of the mounting slot 11 of the keystone wall plate 1 or keystone panel, defining therein a second accommodation chamber 332 in communication with the aforesaid first accommodation chamber 32 for accommodating the aforesaid D-shape connector body 2.

The circuit board 4 is mounted in the first accommodation chamber 32 and the second accommodation chamber 332 at the bottom side, having a plurality of front via holes 41 disposed near the front side thereof for receiving the conducting terminals 21 of the D-shape connector body 2 electrically and a plurality of rear via holes 42 disposed near the rear side thereof.

Each terminal block 5 comprises a plurality of conducting terminals 51 electrically connected to the respective rear via holes 42 of the circuit board 4. By means of the at least one terminal block 5, the circuit board 4 is electrically connected with at least one cable (not shown).

By means of the at least one hook 31, the D-shape connector body 2 can be conveniently installed in one mounting slot 11 on the front side of a keystone wall plate 1 or keystone panel from the front side and positively secured thereto in position. Thus, the invention enhances the application range and convenience of use of the front load keystone D-shape connector.

In the aforesaid first embodiment of the invention, the D-shape connector body 2 is a D-subminiature female connector. In actual practice, the D-shape connector body 2 can be a D-subminiature male connector, digital visual interface female connector or digital visual interface male connector. The D-subminiature female connector or D-subminiature male connector can be selected from the group of DB9 (9 PIN), DB15 (15 PIN), DB19 (19 PIN), DB23 (23 PIN), DB25 (25 PIN), DB37 (37 PIN), DB50 (50 PIN) or high-density D-SUB connector (HDDB15, HDDB26, HDDB44, HDDB62).

Further, the rear extension block 33 of the frame shell 3 comprises a groove 330 located on each of two opposite lateral sidewalls thereof, and a springy hook 333 disposed adjacent to each groove 330 and terminating in a hooked portion 3331. After insertion of the front load keystone D-shape connector into one mounting slot 11 on the front side of a keystone wall plate 1 or keystone panel and hooking of the hooked portion 311 of each hook 31 on the locating flange 111 on the back side of the keystone wall plate 1 or keystone panel around the mounting slot 11, the hooked portion 3331 of each springy hook 333 of the rear extension block 33 of the frame shell 3 is hooked on the locating flange 111 at a relatively lower location below the hook 31.

Further, the rear extension block 33 of the frame shell 3 comprises a retaining hole 334 located on each of two opposite upright sidewalls thereof. The circuit board 4 comprises two retaining blocks 43 respectively protruded from two opposite lateral sides thereof and respectively forced into engagement with the retaining holes 334 of the rear extension block 33 of the frame shell 3, enhancing connection stability between the frame shell 3 and the circuit board 4.

Further, each terminal block 5 according to this first embodiment of the invention is made in the form of a screw terminal. Alternatively, each terminal block 5 can be made in the form of an IDC (insulation displacement connector).

Figure 10:
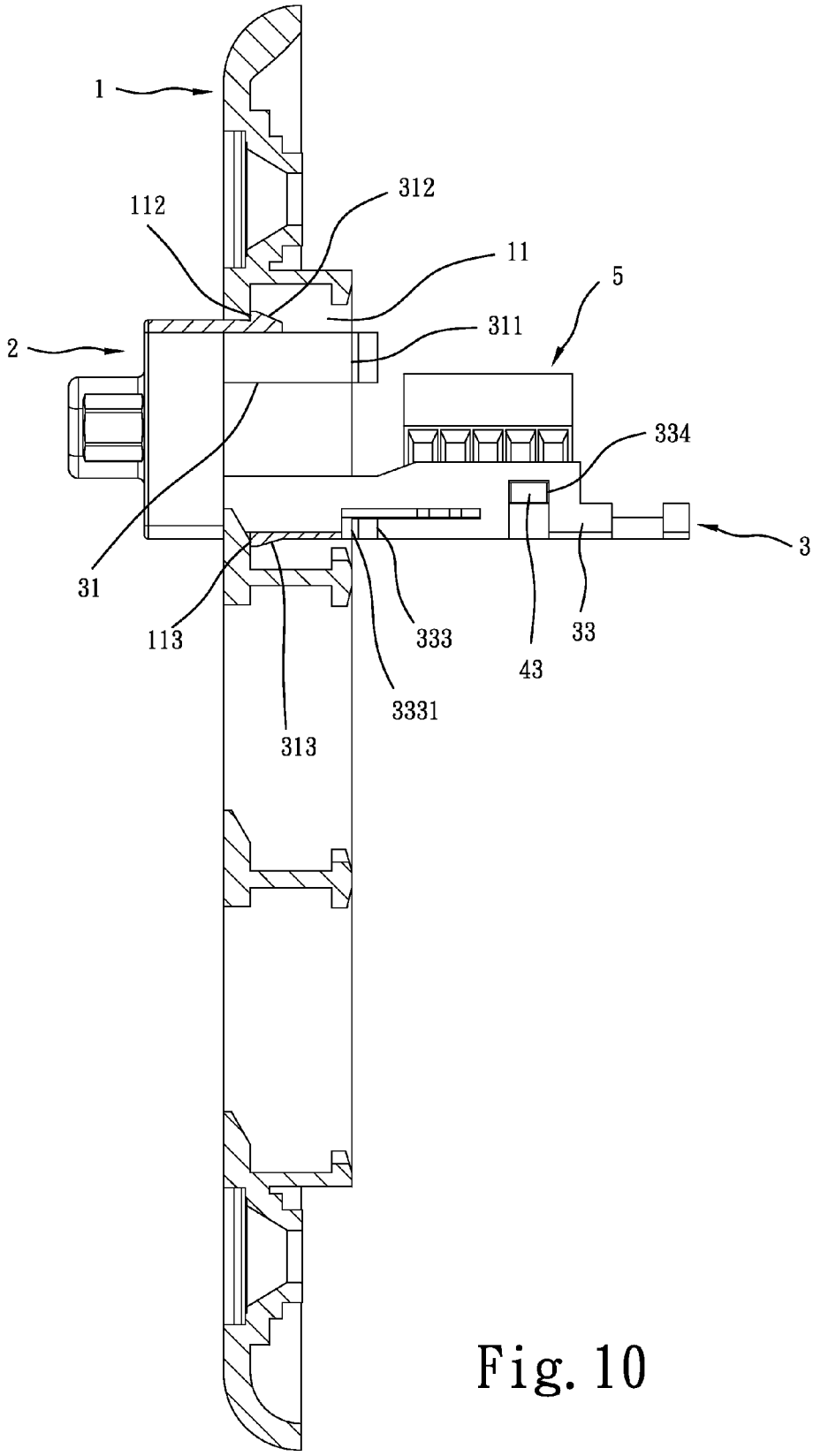
FIG. 10 is a sectional side view illustrating a front load keystone D-shape connector installed in a keystone wall plate in accordance with a second embodiment of the present invention.

FIG. 10 illustrates a front load keystone D-shape connector in accordance with a second embodiment of the present invention. According to this second embodiment, the frame shell 3, in addition to the arrangement of the at least one hook 31 and the springy hooks 333 of the rear extension block 33 for hooking on the locating flange 111 on the back side of a keystone wall plate 1 or keystone panel around one mounting slot 11 of the keystone wall plate 1 or keystone panel, the frame shell 3 further comprises at least one hook 312 respectively backwardly extended from the back side thereof and at least one hook 313 extended from the rear extension block 33 for hooking on a top flange 112 at the top side of the mounting slot 11 and a bottom flange 113 at the bottom side of the mounting slot 11, enhancing the connection stability between the front load keystone D-shape connector and the keystone wall plate 1 or keystone panel. Other technical features of this second embodiment are same as the aforesaid first embodiment. In generally, this second embodiment uses the extra at least one hook 312 and at least one hook 313 to enhance the connection stability between the front load keystone D-shape connector and the keystone wall plate 1 or keystone panel.

Figure 11:
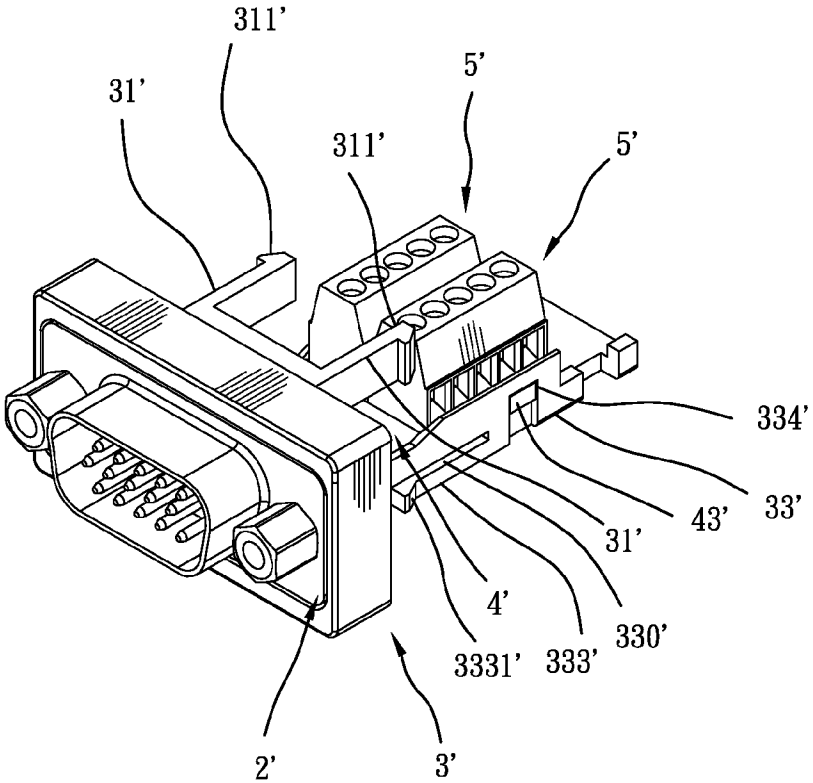
FIG. 11 is an elevational assembly view of a front load keystone D-shape connector in accordance with a third embodiment of the present invention.

FIG. 11 illustrates a front load keystone D-shape connector in accordance with a third embodiment of the present invention. Similar to the aforesaid first embodiment, the front load keystone D-shape connector of this third embodiment consists of a D-shape connector body 2', a frame shell 3', a circuit board 4' and at least one terminal block 5'. Similar to the aforesaid first embodiment, the frame shell 3' comprises at least one hook 31' each hook 31' terminating in a hooked portion 311'; the rear extension block 33' comprises springy hooks 333' disposed adjacent to each groove 330', each springy hook 333' terminating in a hooked portion 3331'; the rear extension block 33' of the frame shell 3' comprises two retaining holes 334' respectively located on the two opposite upright sidewalls thereof for engagement with the respective retaining blocks 43' of the circuit board 4'. The minor difference between the aforesaid first embodiment and this third embodiment is that the D-shape connector body 2' of this third embodiment is a D-subminiature male connector. Other technical features remain unchanged.

Figure 12:
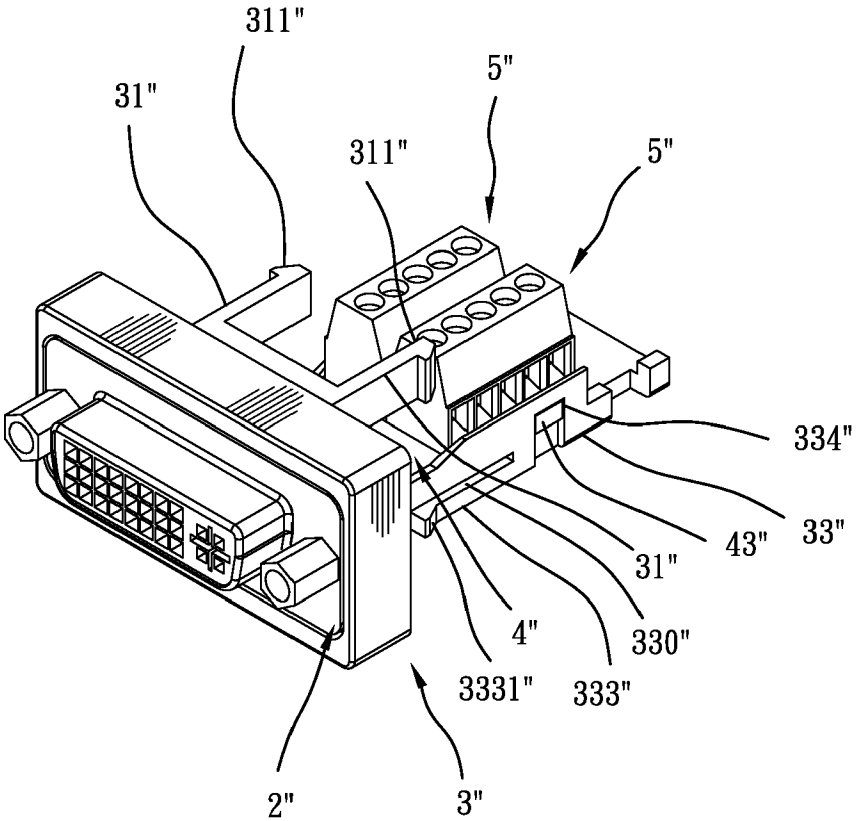
FIG. 12 is an elevational assembly view of a front load keystone D-shape connector in accordance with a fourth embodiment of the present invention.

FIG. 12 illustrates a front load keystone D-shape connector in accordance with a fourth embodiment of the present invention. Similar to the aforesaid first embodiment, the front load keystone D-shape connector of this fourth embodiment consists of a D-shape connector body 2", a frame shell 3", a circuit board 4" and at least one terminal block 5". Similar to the aforesaid first embodiment, the frame shell 3" comprises at least one hook 31" each hook 31" terminating in a hooked portion 311"; the rear extension block 33" comprises springy hooks 333" disposed adjacent to each groove 330", each springy hook 333" terminating in a hooked portion 3331"; the rear extension block 33" of the frame shell 3" comprises two retaining holes 334" respectively located on the two opposite upright sidewalls thereof for engagement with the respective retaining blocks 43" of the circuit board 4". The minor difference between the aforesaid first embodiment and this fourth embodiment is that the D-shape connector body 2''' of this fourth embodiment is a DVI (digital video interface) female connector. Other technical features remain unchanged.

In conclusion, the invention provides a front load keystone D-shape connector that has advantages as follows:

1. The D-shape connector body 2 can be directly installed in one mounting slot 11 on a front side of a keystone wall plate 1 or keystone panel from the front side. Therefore, the invention enhances the convenience of the use of D-subminiature connectors and digital visual interface connectors.
2. The invention broadens the application range of D-subminiature male/female connectors and digital visual interface male/female connectors.

What is claimed is:

1. A front load keystone D-shape connector for installation in a mounting slot on a keystone wall plate/keystone panel, the front load keystone D-shape connector comprising a D-shape connector body having a plurality of conducting terminals located on one side thereof, a frame shell holding said D-shape connector body therein and mountable in one mounting slot on a keystone wall plate/keystone panel, said frame shell comprising at least one hook backwardly extended from a back side thereof and adapted for insertion into one mounting slot on the keystone wall plate/keystone panel from a front side of said keystone wall plate/keystone panel for hooking on a part of said keystone wall plate/keystone panel inside said mounting slot.

2. The front load keystone D-shape connector as claimed in claim 1, wherein each said hook of said D-shape connector body comprises a hooked portion located on a distal end thereof for hooking on a part of said keystone wall plate/keystone panel inside said mounting slot.

3. The front load keystone D-shape connector as claimed in claim 2, wherein the hooked portion of each said hook of said D-shape connector body is adapted for hooking on a locating flange on a back side of said keystone wall plate/keystone panel around said mounting slot.

4. The front load keystone D-shape connector as claimed in claim 3, wherein the hooked portion of each said hook of said D-shape connector body is adapted for hooking on one of top and bottom sides of said locating flange of said mounting slot of said keystone wall plate/keystone panel.

5. The front load keystone D-shape connector as claimed in claim 1, wherein said frame shell comprises a first accommodation chamber located on a front side thereof, and a rear extension block backwardly extended from the back side thereof, said rear extension block having a height and a width relatively smaller than the height and width of said mounting slot of said keystone wall plate/keystone panel, said rear extension block comprising a second accommodation chamber in communication with said first accommodation chamber for accommodating said D-shape connector body, a groove located on each of two opposite lateral sidewalls thereof, a springy hook respectively disposed adjacent to each said groove, each said springy hook of said rear extension block comprising a hooked portion for hooking on a bottom side in said mounting slot of said keystone wall plate/keystone panel, and a retaining hole located on each of the two opposite lateral sidewalls thereof.

6. The front load keystone D-shape connector as claimed in claim 5, further comprising a circuit board mounted in said first accommodation chamber and said second accommodation chamber, said circuit board comprising a plurality of front via holes located on a front side thereof and adapted for receiving the conducting terminals of said D-shape connector body electrically, a plurality of rear via holes located on a rear side thereof and a retaining block located on each of two opposite lateral sides thereof and respectively forced into engagement with the retaining holes of said rear extension block.

7. The front load keystone D-shape connector as claimed in claim 6, further comprising at least one terminal block made in one of the form of a screw terminal and the form of an insulation displacement connector, each said terminal block comprising a plurality of conducting terminals respectively electrically connected to one respective rear via hole of said circuit board.

8. The front load keystone D-shape connector as claimed in claim 1, wherein said D-shape connector body is selected from the group of D-subminiature female connector, D-subminiature male connector, digital visual interface female connector and digital visual interface male connector.

9. A front load keystone D-shape connector, comprising:

a D-shape connector body having a plurality of conducting terminals located on one side thereof, a frame shell holding said D-shape connector body therein and mountable in one mounting slot on a keystone wall plate/keystone panel, said frame shell comprising at least one hook backwardly extended from a back side thereof and adapted for insertion into one mounting slot on the keystonewall plate/keystone panel from a front side of said keystone wall plate/keystone panel for hooking on a part of said keystone wall plate/keystone panel inside said mounting slot, a first accommodation chamber located on a front side thereof, and a rear extension block backwardly extended from the back side thereof, said rear extension block having a height and a width relatively smaller than the height and width of said mounting slot of said keystone wall plate/keystone panel, said rear extension block comprising a second accommodation chamber in communication with said first accommodation chamber for accommodating said D-shape connector body;

a circuit board mounted in said first accommodation chamber and said second accommodation chamber, said circuit board comprising a plurality of front via holes located on a front side thereof and adapted for receiving the conducting terminals of said D-shape connector body electrically, a plurality of rear via holes located on a rear side thereof; and at least one terminal block made in one of the form of a screw terminal and the form of an insulation displacement connector, each said terminal block comprising a plurality of conducting terminals respectively electrically connected to one respective rear via hole of said circuit board.

10. The front load keystone D-shape connector as claimed in claim 9, wherein each said hook of said frame shell comprises a hooked portion located on a distal end thereof for hooking on a part of said keystone wall plate/keystone panel inside said mounting slot.

11. The front load keystone D-shape connector as claimed in claim 10, wherein the hooked portion of each said hook of said frame shell is adapted for hooking on a locating flange on a back side of said keystone wall plate/keystone panel around said mounting slot.

12. The front load keystone D-shape connector as claimed in claim 9, wherein the hooked portion of each said hook of said frame shell is adapted for hooking on one of top and bottom sides of said locating flange of said mounting slot of said keystone wall plate/keystone panel.

13. The front load keystone D-shape connector as claimed in claim 9, wherein said D-shape connector body is selected from the group of D-subminiature female connector, D-subminiature male connector, digital visual interface female connector and digital visual interface male connector.

14. The front load keystone D-shape connector as claimed in claim 9, wherein said rear extension block comprises a groove located on each of two opposite lateral sidewalls thereof, and a springy hook respectively disposed adjacent to each said groove, each said springy hook of said rear extension block comprising a hooked portion for hooking on a bottom side in said mounting slot of said keystone wall plate/keystone panel, and a retaining hole located on each of the two opposite lateral sidewalls thereof.

15. The front load keystone D-shape connector as claimed in claim 14, wherein the two springy hooks of said rear extension block are hooked in a bottom side in said mounting slot of said keystone wall plate/keystone panel.

16. The front load keystone D-shape connector as claimed in claim 9, wherein said rear extension block comprises a retaining hole located on each of two opposite upright sidewalls thereof; said circuit board comprises a retaining block located on each of two opposite lateral sides thereof and respectively forced into engagement with the retaining holes of said rear extension block.

17. The front load keystone D-shape connector as claimed in claim 9, wherein said at least one terminal block is respectively made in one of the form of a screw terminal and the form of an insulation displacement connector.

* * * * *